US005711327A

United States Patent [19]

Fields

[11] Patent Number: 5,711,327

[45] Date of Patent: Jan. 27, 1998

[54] SYSTEM FOR VIBRATION CLEANING OF ARTICLES INCLUDING RADIATORS

[76] Inventor: John T. Fields, 2107 E. 48th St., Tulsa, Okla. 74105

[21] Appl. No.: 541,532

[22] Filed: Oct. 10, 1995

[51] Int. Cl.[6] ..... B08B 3/10

[52] U.S. Cl. ..... 134/105; 134/201; 134/184; 366/114; 366/127; 68/3 SS

[58] Field of Search ..... 134/1, 184, 201, 134/105; 366/128, 127, 114; 68/3 SS; 310/348, 354; 164/260, 203, 206, 71, 83; 209/324, 326, 332, 361, 366.5, 367

[56] References Cited

U.S. PATENT DOCUMENTS

| | | | |
|---|---|---|---|
| 1,388,097 | 8/1921 | Capsoni | 366/128 |
| 1,413,672 | 4/1922 | Lowe | 209/367 |
| 1,752,266 | 3/1930 | Sloan | 164/203 |
| 2,037,568 | 4/1936 | Emmerling et al. | 68/3 SS |
| 2,174,013 | 9/1939 | Schrey | 366/128 |
| 2,559,472 | 7/1951 | Shanaman | 134/94 |
| 2,559,864 | 7/1951 | Firth | 68/3 SS |
| 2,585,464 | 2/1952 | Hovden | 68/3 SS |
| 2,623,376 | 12/1952 | Volk et al. | 68/3 SS |
| 2,629,244 | 2/1953 | Rand | 68/3 SS |
| 2,694,307 | 11/1954 | Henry | 68/3 SS |
| 2,702,692 | 2/1955 | Kessler | 366/127 |
| 2,720,210 | 10/1955 | Lueck | 134/94 |
| 2,828,114 | 3/1958 | Radszus | 134/184 |
| 2,888,939 | 6/1959 | Nitsche | 68/3 SS |
| 2,895,319 | 7/1959 | Rochefort | 68/3 SS |
| 2,896,649 | 7/1959 | Faidley | 134/184 |
| 2,919,215 | 12/1959 | Neuhaus et al. | 68/3 SS |
| 2,937,292 | 5/1960 | Welkowitz et al. | 68/3 SS |
| 2,985,003 | 5/1961 | Gelfand et al. | 134/184 |
| 3,117,768 | 1/1964 | Carlin | 366/127 X |
| 3,371,233 | 2/1968 | Cook | 134/184 |
| 3,481,687 | 12/1969 | Fishman | 134/184 |
| 3,596,883 | 8/1971 | Brech | 134/184 |
| 3,709,732 | 1/1973 | Thomen | 134/184 |
| 3,822,054 | 7/1974 | Matson | 366/114 |
| 3,871,395 | 3/1975 | Murry | 134/184 |
| 3,938,905 | 2/1976 | Wadensten | 366/114 |
| 3,945,226 | 3/1976 | Hedouville | 68/23.1 |
| 4,080,975 | 3/1978 | Williams, Jr. | 134/94 |
| 4,226,642 | 10/1980 | Baran | 134/10 |
| 4,353,391 | 10/1982 | Winters | 134/111 |
| 4,372,787 | 2/1983 | Fields et al. | 134/1 |
| 4,403,735 | 9/1983 | Weaver | 239/1 |
| 4,727,896 | 3/1988 | Kanazawa et al. | 134/183 |
| 4,909,266 | 3/1990 | Massa | 134/184 |
| 5,133,376 | 7/1992 | Samarin et al. | 134/184 |
| 5,450,733 | 9/1995 | Kim et al. | 68/3 SS |

FOREIGN PATENT DOCUMENTS

| | | | |
|---|---|---|---|
| 1062808 | 12/1953 | France | 68/3 SS |
| 1589890 | 5/1970 | France | 68/3 SS |
| 2518939 | 11/1976 | Germany | 68/3 SS |
| 2601549 | 12/1976 | Germany | 68/3 SS |
| 488883 | 1/1951 | Italy | 68/3 SS |
| 54-103269 | 8/1979 | Japan | 134/184 |
| 648609 | 1/1951 | United Kingdom | 68/3 SS |
| 1456140 | 11/1976 | United Kingdom | 134/184 |

*Primary Examiner*—Frankie L. Stinson

*Attorney, Agent, or Firm*—John D. Gassett; Frank J. Catalano; Scott R. Zingerman

[57] ABSTRACT

A method and apparatus for cleaning articles such as radiators, pizza pans, carburetors, engine parts. A suitable cleaning fluid is placed in a container, and the article to be cleaned is placed in this cleaning fluid. A vibrator is attached to the container such that the vibrations are transferred to the cleaning fluid to clean the articles. The induced waves in the cleaning fluid is a powerful scrubbing force.

1 Claim, 6 Drawing Sheets

SYSTEM FOR VIBRATION CLEANING OF ARTICLES INCLUDING RADIATORS

BACKGROUND OF THE INVENTION

1. Field of the Invention

This invention relates to improvements in method and means for cleaning radiators and other articles.

2. Description of the Prior Art

Radiators of all sizes are in widespread use today in many areas such as the conventional vehicle radiators, industrial radiators, and the like. During utilization of these radiators, the header members which normally support the outer ends of the heat exchanger tubes of the radiator, frequently become encrusted with radiator deposits from the fluid normally utilized in connection with the radiator. This accumulation of residue and the like hinders the efficient operation of the radiator. As a result, it is common practice to clean the radiator for improving the operational performance thereof. The tanks are normally removed to aid cleaning.

Perhaps the most effective and widely used radiator cleaner presently in use is described in U.S. Pat. No. 4,372,787 entitled, "Method for Ultrasonic Cleaning of Radiators". The inventors were John T. Fields et al. This patent issued on Feb. 8, 1983. In that system a radiator having a header is cleaned by at least partially immersing the radiator in a cleaning liquid so that the header is immersed in the cleaning liquid and then applying ultrasonic energy to the cleaning fluid, energy sufficient to cause cavitation of the liquid. The ultrasonic transducer used had frequency of 20,000 cycles per second (cps) to about 40,000 cps. The ultrasonic cleaning operation depends upon cavitation, which is a rapid formation and violent collapse of minute bubbles or cavity in the cleaning liquid. In the ultrasonic units the cleaning process is based on tens of thousands of electronically induced imploding bubbles from which the cleaning power is derived. This action by countless small and intense imploding bubbles creates scrubbing of both exposed and hidden surfaces of parts. This has been a good radiator cleaning system, but the costs of the ultrasonic equipment is rather high. With the hostile environment of the radiator shop, ultrasonic transducers and generators will always have an endless appetite for expensive repairs. The breakdowns were caused by two primary reasons, the main being the type of atmosphere within radiator shops which is corrosive by nature. The other was the poor housekeeping practices of shops which also affected the workings of the ultrasonic units.

It is one object of this invention to provide a more efficient and/or less costly method and apparatus for cleaning a radiator or other article with encrusted deposits thereon, such as engine valves, carburetors, radiators, pizza pans, and so forth.

SUMMARY OF THE INVENTION

The present invention is a novel method of cleaning automobile radiators and other articles which has encrusted deposits thereon. Broadly, the invention includes a method of placing a cleaning fluid in a container, placing an article to be cleaned in the cleaning fluid, then vibrating the container by a vibrator rigidly attached to the outer wall of the container such that vibrations are transferred to the cleaning fluid to clean the articles therein. To obtain cleaning of articles that are placed in the fluid, waves are induced into such cleaning fluid with frequency and force to effectively and efficiently clean the article. Thus the cleaning is primarily due to wave action in the fluid caused by such vibrations. After the articles have been cleaned, they are removed from the cleaning fluids.

In a preferred embodiment of my invention, a vibrator is rigidly supported on the outside of the container at the bottom. Typically, it has been found that for cleaning purposes, in a 30 inch by 18 inch by 18 inch tank using an aqueous base cleaning solution, that 1800 vibrations per minute (VPM) is the optimum for cleaning articles such as radiators and pizza baking pans, etc. That VPM with 44 pounds force works fine. Heating means are provided to maintain the desired temperature of the cleaning fluid. Also, suitable filling and draining conduits and valves are provided. The vibrators are such as to obtain the required frequency and are spaced such that the system has good bottom coverage of the waves in the cleaning fluid. This method is exceptionally good for cleaning hard-to-get places in the article being cleaned. Further, it has been found that radiator headers do not have to be removed from radiators when cleaning them. This system can be used for articles such as those having baked on organic deposits or encrusted deposits.

DETAILED DESCRIPTION OF THE INVENTION

Figure 1:
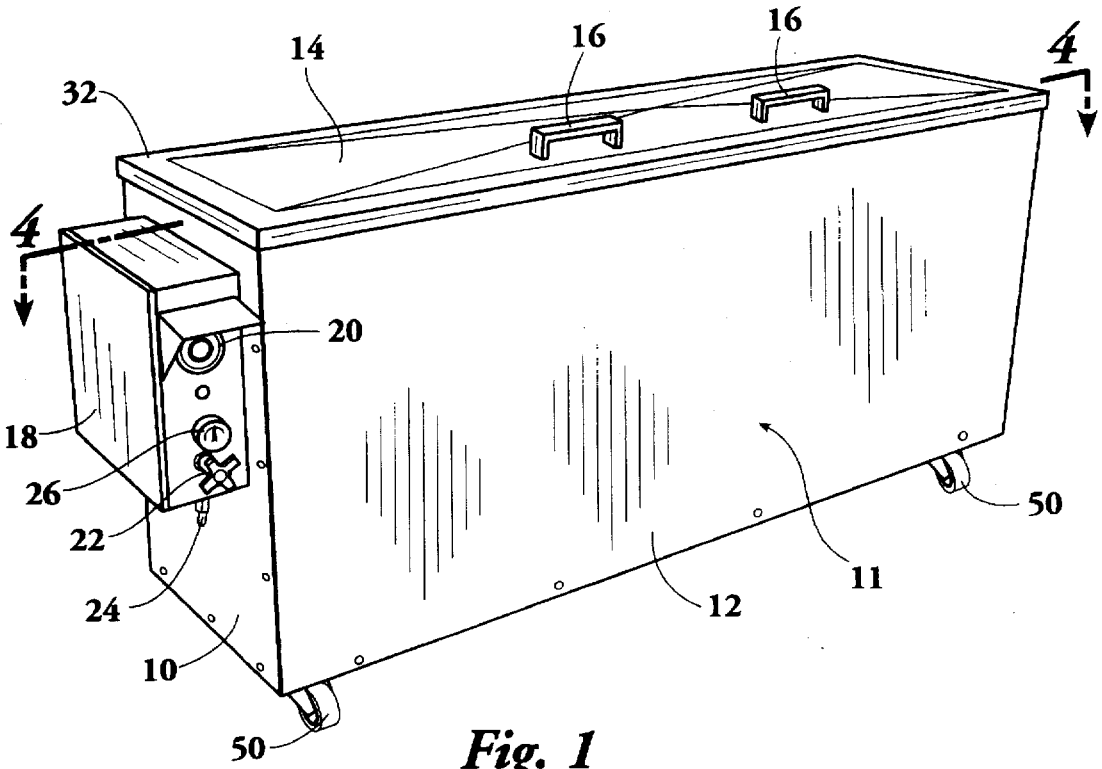
FIG. 1 is a perspective view of the cleaning system of my invention showing the outer skin or tank, gauge, and control panel.
Figure 2:
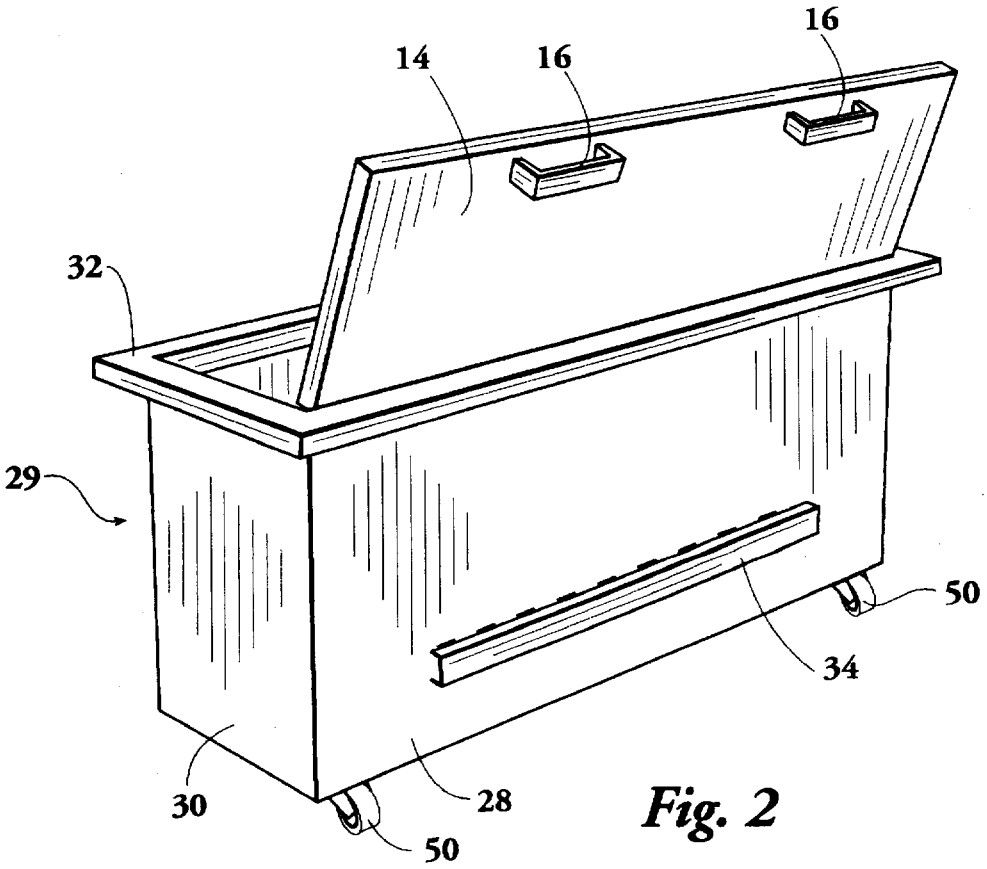
FIG. 2 is a perspective view showing the inner container or skin of the device of FIG. 1 with the outer skin removed.
Figure 3:
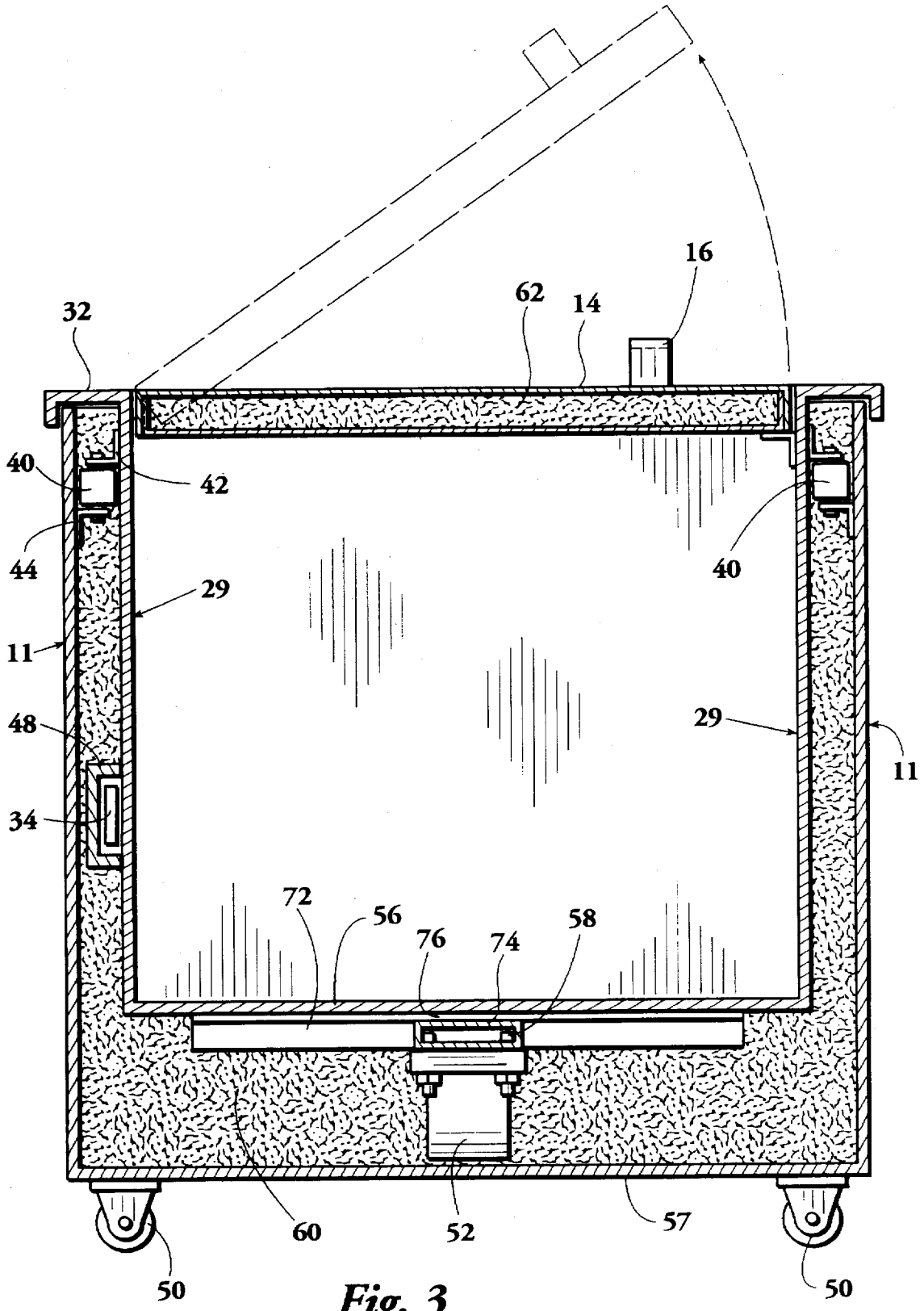
FIG. 3 is a view taken along the line 3—3 of FIG. 5.

Attention is first directed to FIG. 1 which shows a perspective of the tank system used in my invention. It includes an outer tank or skin 11 having a first end 10 and a front 12. As shown in FIG. 2, a lid 14 with handles 16 is supported from inner container or skin 29. Referring back to FIG. 1, there is a control panel 18 having a temperature control 20 and a valve 22 which is connected to conduit 24 which provides air under pressure to operate the vibrator 52 (FIG. 3). It will be understood that other forms of vibrators can be used with different forms of energy, such as electricity. Also shown is a gauge 26 which indicates the pressure of the air fed to the vibrator. As will be discussed later, the power air pressure controls the output frequency of the vibrator.

The inner skin 29 is normally preferably made of stainless steel. One cleaning fluid which has been used quite successfully in cleaning automobile radiators and pizza pans is Vibrasol 4000 which is a biodegradable, non-flammable cleaner available from Federal Metals, Inc., 1142 S. Norwood, Tulsa, Okla. 74112-5430.

FIG. 2 shows the inner skin or inner tank 29 which is the container of the cleaning fluid and which sits in the outer tank 11 which is illustrated in FIG. 1. This inner tank includes a back 28, an end 30, and a shoulder or lip 32 at the top of the tank which supports top 14. Mounted on the wall 28 is heater 34 which is controlled by temperature control 20 on a control box 18. The wall bottoms are all welded together or otherwise manufactured so there is no escape or leaking of the cleaning fluid. When the inner skin and lid of FIG. 2 is placed inside the outer skin of the wall, it would appear as shown in FIG. 1 in which the lid has been closed about hinges supported by lip 32.

Attention is next directed to FIG. 3 which illustrates a section along the Dine 3—3 of FIG. 1. Shown thereon is the inner skin 29 positioned inside the outer skin 11 and is supported therein with lip 32 positioned over the top of the walls of the outer skin or tank 11. There are shock absorbers, for example, either rubber or steel springs, 40 positioned between the inner skin 29 and the outer skin 11 for supporting the inner tank 29 from the outer tank 11. Means for supporting this include a first angle iron 42 and a second angle iron 44. The first angle iron 42 supports the absorber 40 from the inner skin 29, and the second angle iron 44 supports the other end of the shock absorber 40 from the outer skin 11. A heater 34 is positioned within channel iron 48 which is supported from the inner skin 29. This heater is controlled by temperature control 20 of the control panel 18. The outer skin is supported from the floor by casters 50 which permits the unit to be moved rather easily.

Figure 4:
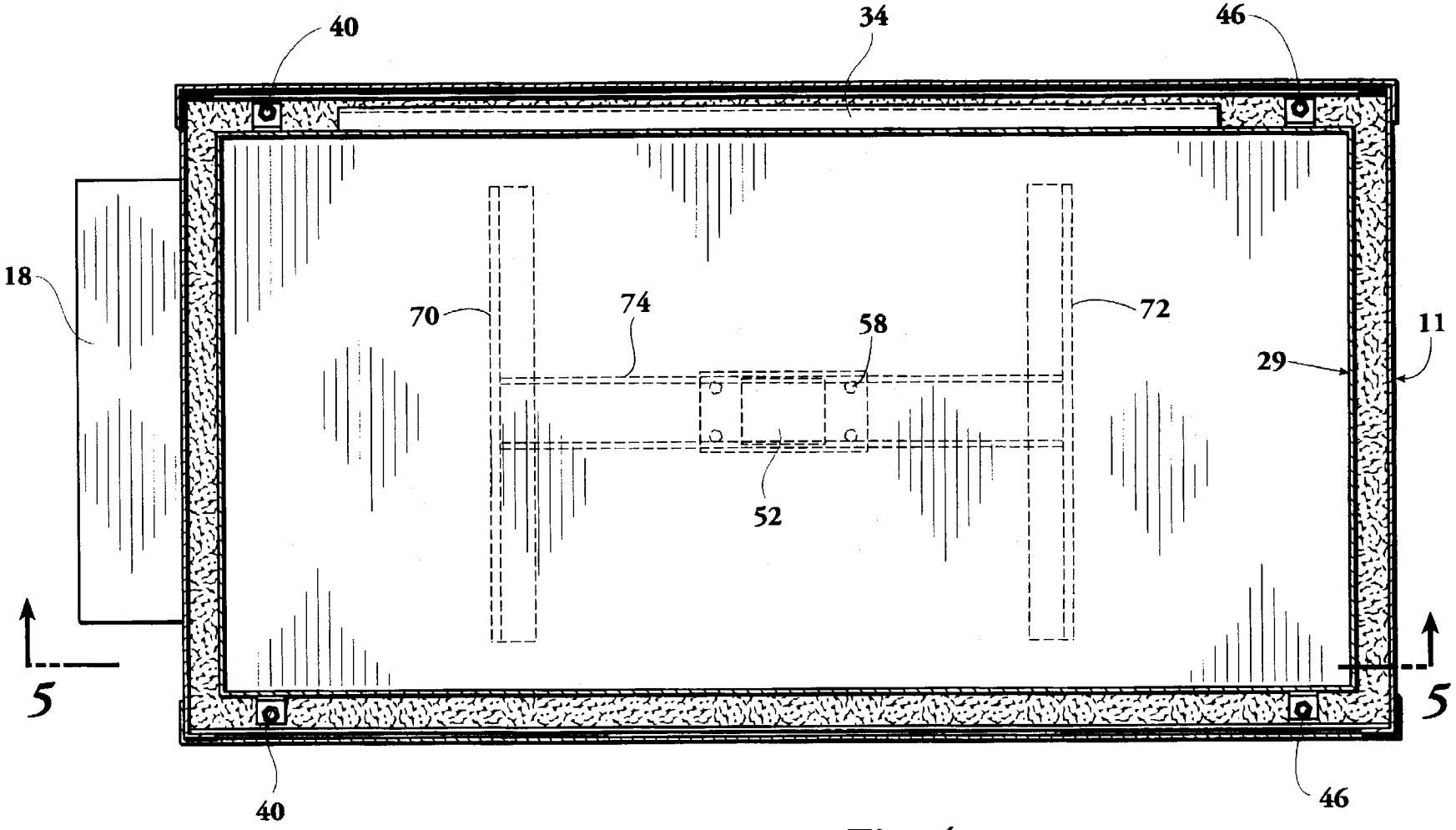
FIG. 4 is a view taken along the line 4—4 of FIG. 1.
Figure 5:
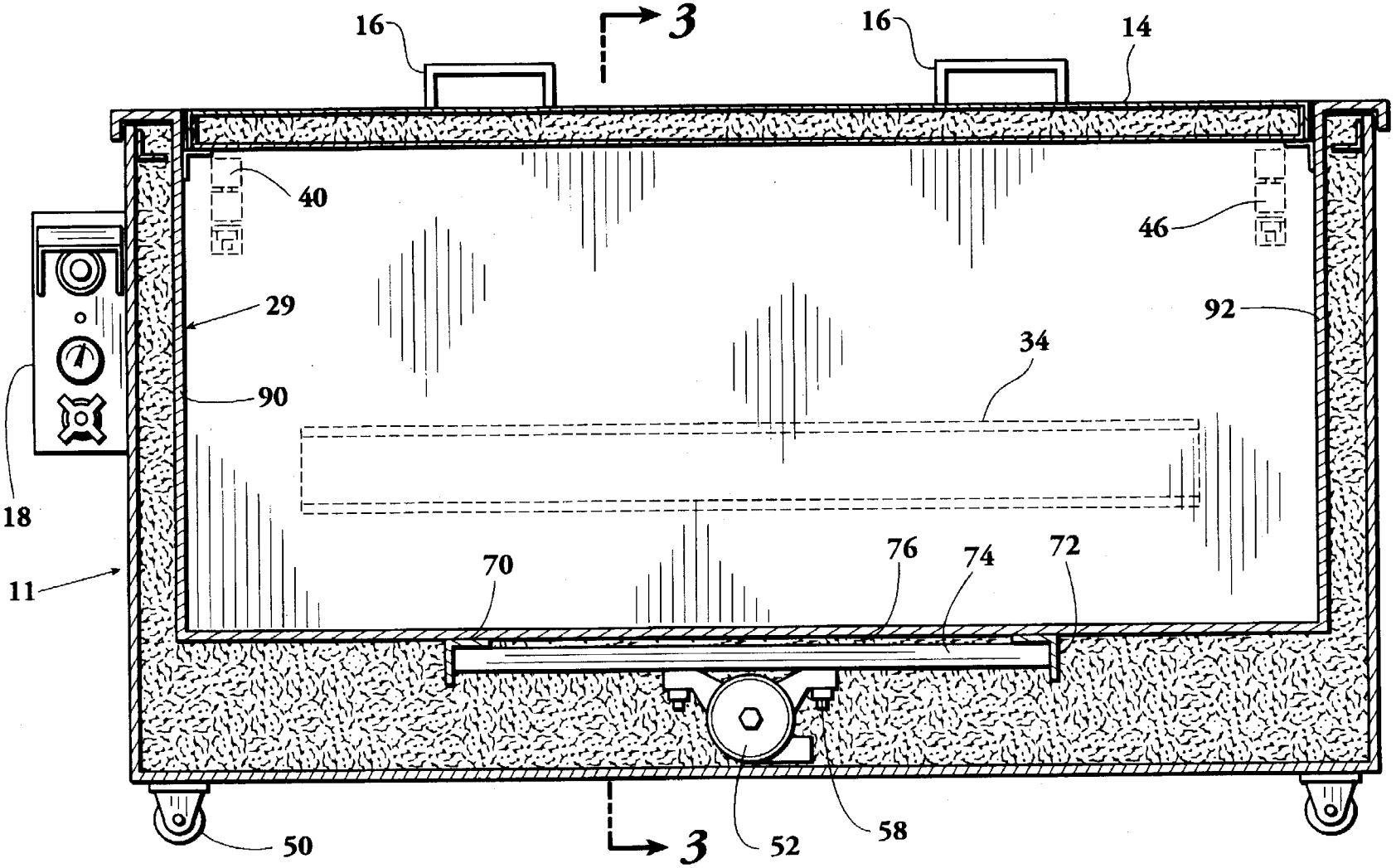
FIG. 5 is a view taken along the line 5—5 of FIG. 4.

Attention is now directed to FIGS. 3, 4, and 5 for an explanation of the preferred manner of supporting vibrator 52 from the bottom 56 of the inner tank 29. As shown in FIG. 5, this includes a square tubular member 74 which is supported at one end by angle iron 70 and at the other end by angle iron 72 which are welded or otherwise securely fixed to the bottom 56. It is seen that there is a space 76 between the bottom 56 of the inner tank and the square tubing 74. The vibrator 52 is supported from the square tubing 74 by bolts 58 or by other suitable means. Vibrations from vibrator 52 are transferred to the inner tank through the square tubing 74 and through angle irons 70 and 72. The distance between ends 90 and 92 of inner tank 29 can be designated "L". The length of the tubular member 74 is about half the length from end 90 to the other end 92 of tank 29 or ½. The angle iron 70 is about one-fourth the distance L from end 90, and angle iron 70 is about one-fourth the distance from end 92. Thus, as the distance between inner walls 90 and 92 is L, then the distance from inner wall 90 to 70 is about ¼. The distance between 70 and 72 is about ½ and the distance between 72 and end 92 is about ¼. That part of the angle iron 70 which is attached to the iron 56 is typically about 2 to 4 inches away from sides 29, and the same applies for angle iron 72 at the point of contact of bottom 56. The distances just discussed in relation to L would be measured at approximately the center of the contact of the upper arm of the angle iron. This has been found to be an acceptable spacing to get good bottom coverage with a single vibrator mounted on the bottom of the tank.

Insulation 60 is provided in the space between outer skin 11 and inner skin 29. Also insulation 62 fills the hollow space of lid 14. The lid 14 is hinged from inner skin 29 at the top thereof.

Attention is next directed to FIG. 4 which is a view taken along the line 4—4 of FIG. 1. The figure illustrates the vibrator 52 which is supported from square tubing 74 which in turn is supported from angle irons 70 and 74 which are secured to the bottom of the inner tank 29 as previously described.

Figure 6:
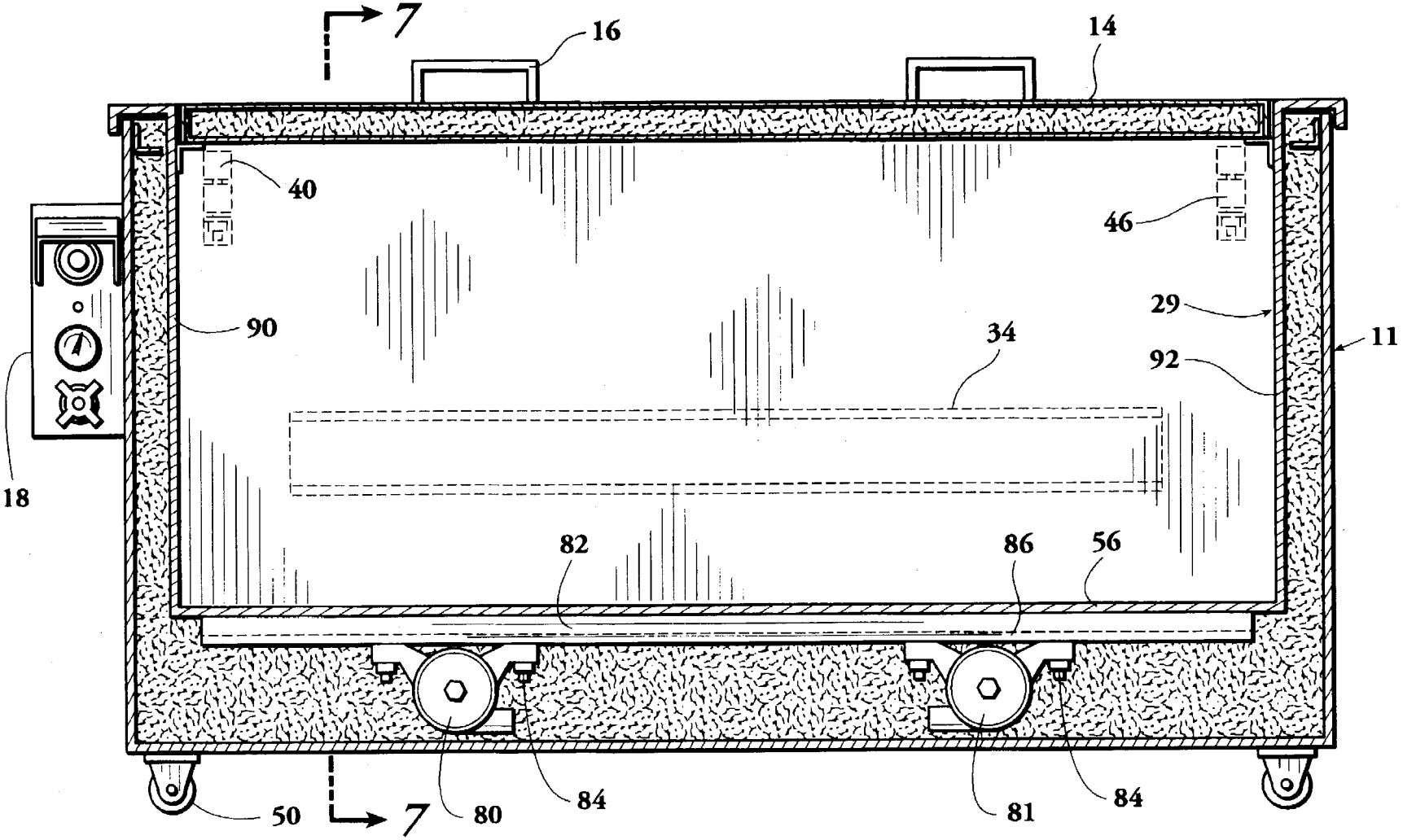
FIG. 6 is a view similar to FIG. 5 except two vibrators are shown.
Figure 7:
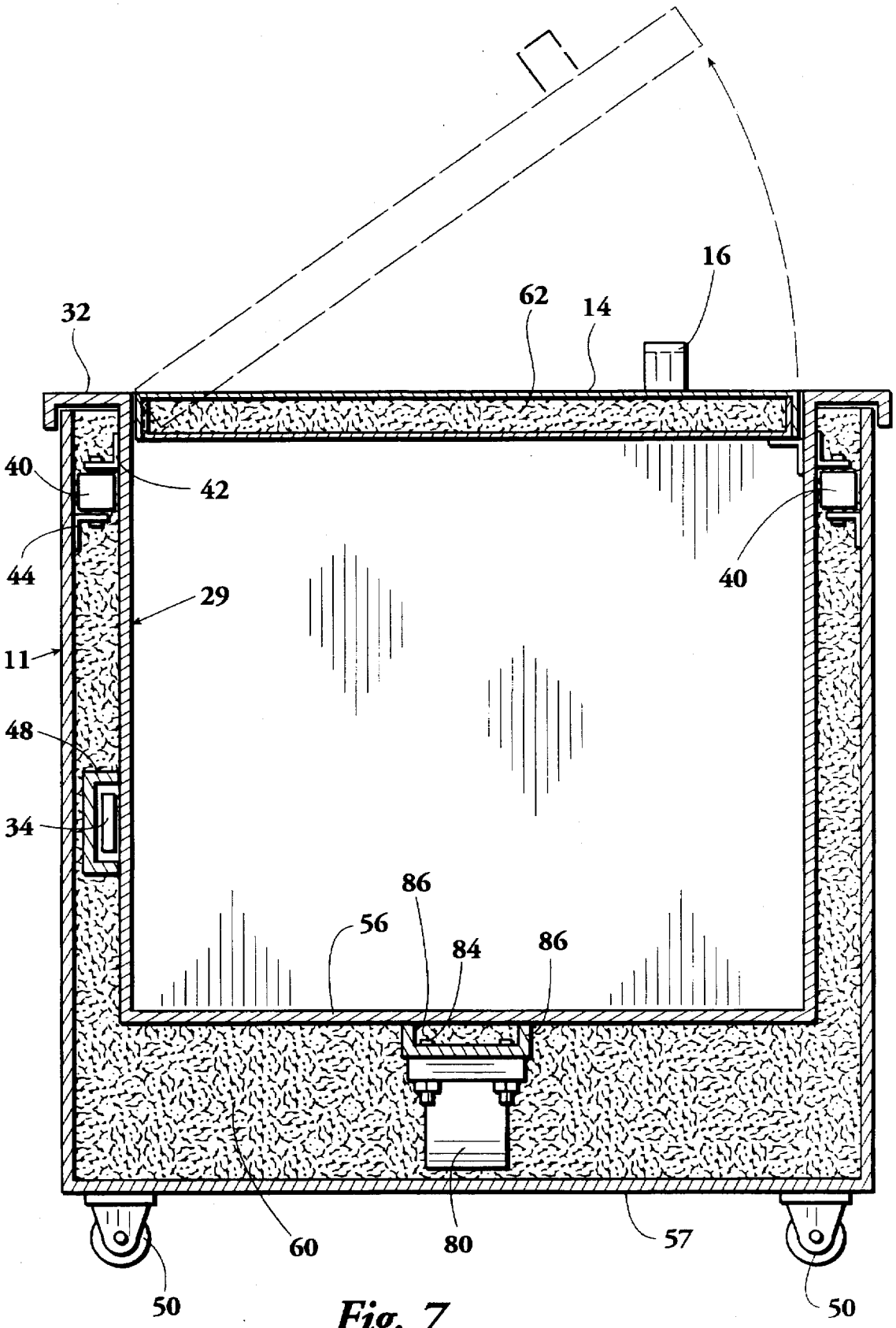
FIG. 7 is a view taken along the line 7—7 of FIG. 6.

Sometimes it is desirable to use more than one vibrator. A suitable arrangement for providing multiple vibrators (two in this Figure) is shown in FIGS. 6 and 7. Shown thereon is a channel iron 86 welded or otherwise secured to the bottom 56 of the inner tank 29. Two vibrators 80 are secured from angle iron 82 by bolts 84. Angle iron 82 each has upright member 86. It is these upright members 86 that are secured to the bottom 56 by welding. A preferred spacing of vibrators 80 and 81 is as follows: Consider L as the distance between one end wall 90 and other end wall 92. Then the spacing of vibrator 80 from end 90 is ¼, and the spacing of vibrator 81 to the end 92 is ¼, and the distance between vibrators 80 and 81 is ½. The center of the vibrators 80 and 81 are considered the measuring points. One should select the proper number and spacing of vibrators to get good bottom coverage to obtain maximum cleaning efficiency. In the 30" by 18" by 18" tank described in the summary it has been found that a single vibrator arrangement such as shown in FIGS. 3 and 5 is quite adequate. A suitable vibrator for many operations is Model FM-32 available from Vibco, Inc., Wyoming, R.I.

Having described the main components of my cleaning system, attention will be directed briefly to its operation. Lid 14 will be opened and a cleaning fluid poured into the inner container 29. The articles to be cleaned are then placed inside the cleaning fluid. Temperature control 20 is set at the desired temperature for the particular cleaning solution provided. Cleaning fluids are sold and are normally provided with a particular desired temperature for their most efficient operation. The lid 14 is then closed, and the vibrator 52 started. The air pressure to it is adjusted to obtain the desired output frequency of the vibrator. This is obtained first by setting the air pressure by opening valve 22 to get the desired air pressure to get the proper frequency. Aggressive vibration of the fluid automatically brings "power scrub" to every external and internal surface of the articles being cleaned, even blind holes and recesses. When the articles are cleaned, the vibrator is stopped, the lid opened, and the clean articles removed.

It is desired to have the present system operating at optimum frequency. In my system the most desired frequency has been found to be the "resonant frequency" of the system. The "resonant frequency" is normally considered that frequency in a forced system of maximum response. That frequency is the most efficient way for transferring energy through a medium. Perhaps the best way to determine the resonant frequency for my invention is to select the size container to handle the articles which are to be cleaned, add the cleaning fluid, and then determine the resonant frequency of that system. The method of determining the resonant frequency and the force obtained of a system is well known. Most cleaning fluids are primarily water with selected chemicals added. Thus, in making these tests to determine the resonant frequency, one can normally use just water in the cleaning fluid tank.

Tests have been run using a 30"×18"×18" steel tank filled with water, and a vibrator (such as Model FM-32 and manufactured by Vibco, Inc. of Wyoming, R.I.) with variable output frequency was used. It was concluded in the testing that this described system responds best at 1800 vibrations per minute (VPM). This is considered to be the resonant frequency of the system.

One has to select a vibrator which will have adequate force to perform the cleaning. Force is a function of frequency and amplitude and is a term used in physics. It was found that 44 lbs. of centrifugal force is an acceptable force for the size tank in which the tests were performed at a frequency of 1800 VPM.

Vibrators presently available induce frequencies from quite low, e.g. 10 vpm or less and a maximum of about 10,000 cycles per minute or more and can produce a sinusoidal wave that can move through the fluid which is an important factor.

The spacing of vibrator(s) is such as to get good bottom coverage with the vibrators mounted on the bottom of the tank. If only one vibrator is used, it would preferably be placed at the center of the bottom of the tank as described hereinabove. If that does not appear to be adequate, then additional vibrators may be used, and they should be properly spaced across the bottom of the tank to get good bottom coverage of the action.

This system can clean any article. Such articles include radiators, pizza pans, carburetors, engine parts, and just about any articles that can withstand the wave action. The invention is not limited to such listed articles which are listed to show the wide range of my invention. It will also clean any article which has baked on organic deposits from cooked food. Anyone who has cleaned such cooking articles the old fashioned way with a brush and harsh chemicals will certainly appreciate the new system described herein.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. An apparatus for cleaning an article which comprises:

a container for receiving a cleaning fluid in which the cleaning fluid is in contact with the inner wall of said container;

a vibrator attached to the wall of said container;

means to actuate said vibrator;

a heater to heat the liquid and means for controlling the temperature of cleaning fluid within said container;

spaced apart parallel angle irons welded to the underside of the bottom of said container;

a square tube extending between the two angle irons and welded therto and in a manner as to leave a space between the square tube and the outside of the bottom of the tank;

said vibrator is attached to said square tube;

said container is rectangular having two spaced apart ends a distance of L apart in which one angle iron is 1/4 from one end and the other angle iron is 1/4 from the other end, with the distance between the angle irons 1/2.

* * * * *